United States Patent [19]

Laux et al.

[11] 4,259,064

[45] Mar. 31, 1981

[54] CERAMIC BURNER

[75] Inventors: Walter Laux, Wiesbaden; Rudolf Hebel, Ginsheim; Peter Artelt, Goslar; Gerhard Esfeld; Arnold Jacob, both of Salzgitter, all of Fed. Rep. of Germany

[73] Assignees: Didier-Werke AG, Wiesbaden; Stahlwerke Peine-Salzgitter AG, Peine, both of Fed. Rep. of Germany

[21] Appl. No.: 19,011

[22] Filed: Mar. 5, 1979

[30] Foreign Application Priority Data

Mar. 6, 1978 [DE] Fed. Rep. of Germany ..... 2809521

[51] Int. Cl.[3] ..... F24H 1/00

[52] U.S. Cl. ..... 432/222; 431/170; 431/187; 432/217

[58] Field of Search ..... 432/217, 218, 222; 431/170, 181, 187, 188; 239/419, 424.5

[56] References Cited

U.S. PATENT DOCUMENTS

| | | | |
|---|---|---|---|
| 2,196,882 | 4/1940 | Whelpley | 432/218 |
| 3,834,864 | 9/1974 | Jakobi et al. | 432/222 |
| 3,891,384 | 6/1975 | Hovis et al. | 432/217 |
| 4,086,052 | 4/1978 | Laux et al. | 432/217 |

*Primary Examiner*—John J. Camby
*Attorney, Agent, or Firm*—Jim Zegeer

[57] ABSTRACT

A ceramic burner for the combustion chamber of air heaters and the like has a mixing body composed of layers of shaped ceramic bricks, the shaped bricks adjoin each other with radial flanks and engage and mutually interlock with one another by knobs or protuberances and corresponding recesses. The layers of shaped bricks are held together vertically by a ceramic bolding bar. In assembly, the mixing body has a mushroom shape wherein the upper layer shaped bricks have a larger radius than the lower layers.

10 Claims, 4 Drawing Figures

CERAMIC BURNER

Figure 1:
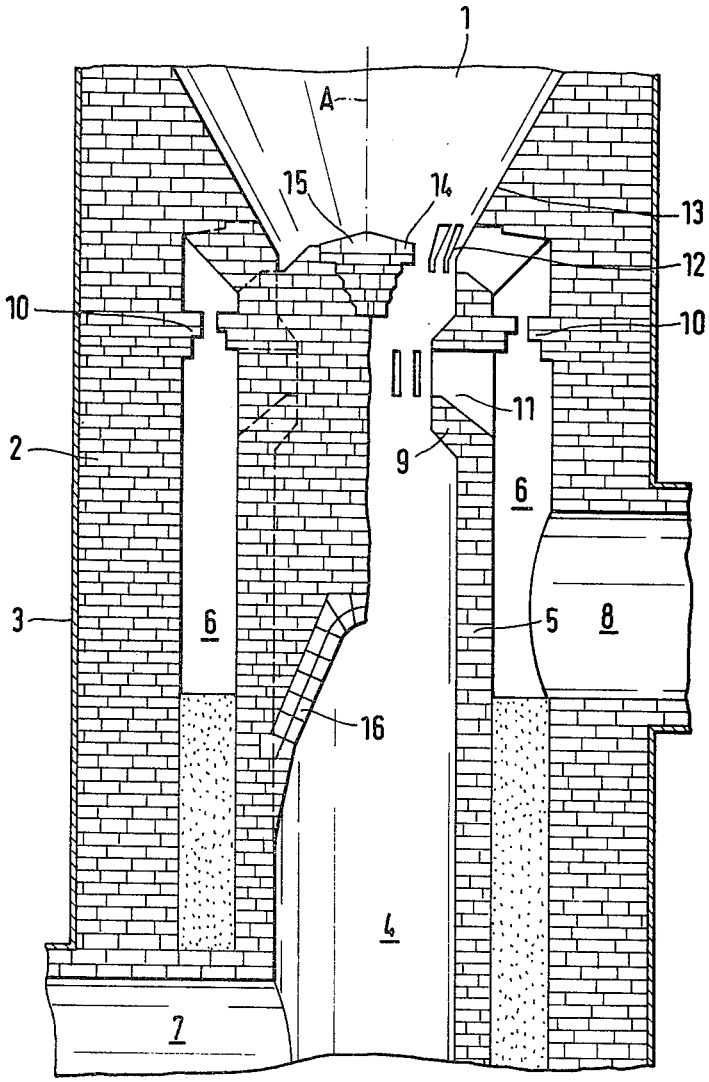

The invention relates to improvements in ceramic burners, and more particularly to improvements in the mixing body and supporting structure for same.

Such a burner has been known from the German OS No. 25 41 991 and corresponding U.S. Pat. No. 4,086,052 incorporated herein by reference. In the case of this burner, the mixing body with the possible exception of a nozzle plate, has been developed monolithically. The production of monolithic mixing bodies of considerable size causes difficulties however, so that attempts have been made of building up the mixing body from fire-resistant, shaped bricks which, however, on the other hand, is accompanied by new disadvantages since in the case of vibrations of the air heater, the construction of the burner, especially at the burner tip and the mixing body will be destroyed. The tying-in of the shaped bricks loses its hold and the burner construction disintegrates.

It is the object of the present invention to create a ceramic burner of the above mentioned type in the case of which these problems are eliminated and especially a burner with a mixing body from shaped bricks is created which will permanently withstand the vibrations occurring during the operation of the burner.

According to the invention, this problem is solved by providing a mixing body which is composed of layers of shaped ceramic bricks, adjoining each other with interlocked flanks and engaged at tops and undersides with knobs or protuberances in corresponding recessess between the layers. It turns out that the radial subdivision of the layers of the mixing body into individual, shaped bricks and their mutual anchoring by knob-recesses engagement avoids both the formation of cracks in the shaped bricks as well as deformations or changes of the shape of the mixing body in the burner tip despite considerable strain by vibration. In the case of horizontal groove and rib elements, a change of shape of the mixing body in vertical direction is avoided or in the case of vertical groove and rib elements, the inherent stability of the mixing body in horizontal direction is even improved further.

It is true that the apertures for the passage of gas may also pass centrally through the individual shaped bricks, however, it is of particular advantage to allow these to adjoin the radial flanks of the shaped bricks so that they are parted centrally by the radial flanks. From a point of view of production engineering, such shaped bricks may be produced more easily and because of avoiding unequal distribution of mass or of narrow ranges of mass, the danger of the formation of cracks is decreased. The vertical inherent stability of the mixing body is ensured by a ceramic holding bar. As ceramic material for the holding bar, especially aluminum oxide or sintered mullite or similar working materials with a good hot tensil strength and hot bending strength at operating temperature come into question. A particularly simple and compact construction of the mixing body according to the invention will be obtained when the shaped bricks constituting the mixing body with a surface pointing towards the burner axis against corresponding surfaces of polygonal shaped or sided brick surrounding the holding bar. The arrangement of the central multiedge or polygonally shaped brick prevents the circular sector shaped molded bricks from forming a layer of the mixing body having too sharp edges which, during transportation and insertion, may be easily damaged and which may also offer problems in the case of the strain from the temperature.

A further feature of the invention is in the shaping of the mixing body so that it has a mushroom shaped cross section. This configuration provides a particularly favorable influence on a good turbulence of the gases in the case of the apertures for the passage of gas being inclined (slanted) at variable angles in relation to the burner axis. Furthermore, the mounting and vertical inherent stability of the mixing body will be improved even further. When the mixing body is tied in by a plurality of masonry brackets directed from the wall of the central supply channel to the central axis of the burner, the tying in reaches up to the upper edge of the mixing body. The shaped bricks of the masonry brackets, in the preferred embodiment there is one for each shaped brick in the top layer of the mixing body, at the same time may be similarly mutually horizontally anchored by knobs or protuberances interlockingly fitted into corresponding recesses as the molded bricks of the mixing body itself.

Figure 2:
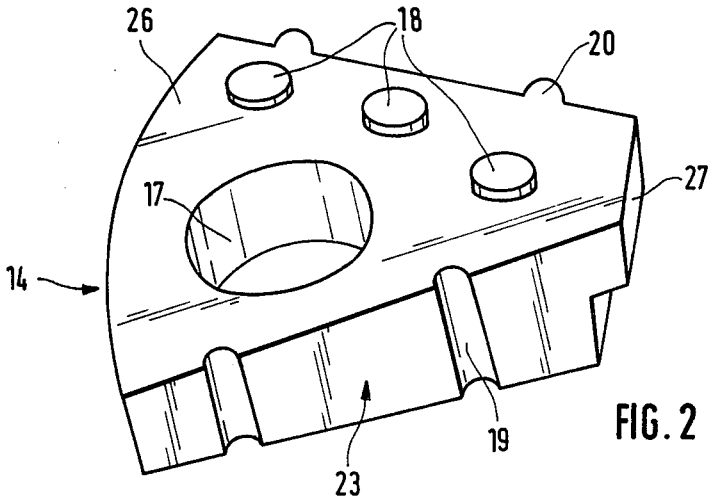
Figure 3:
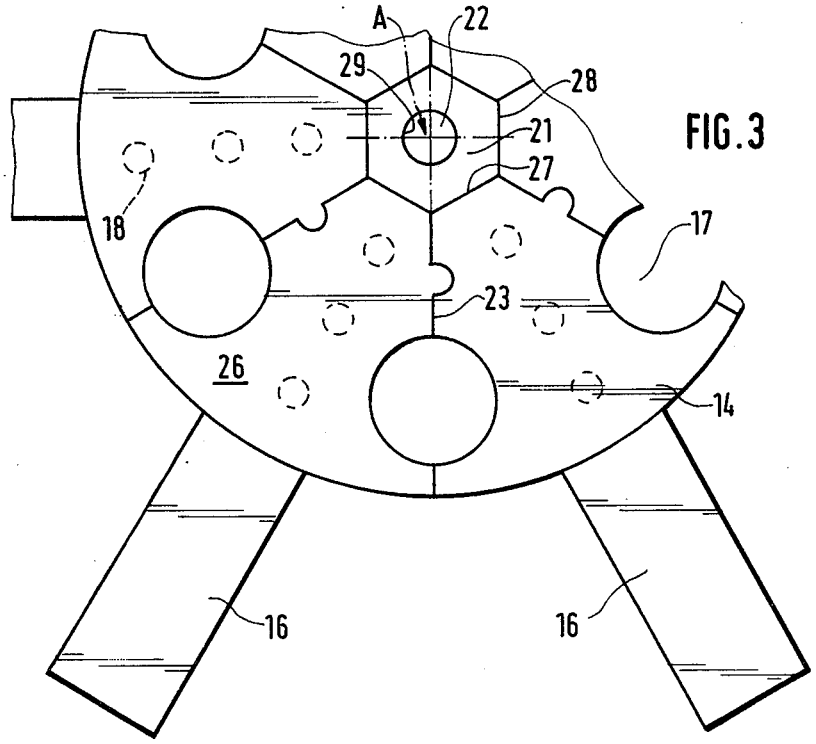
Figure 4:
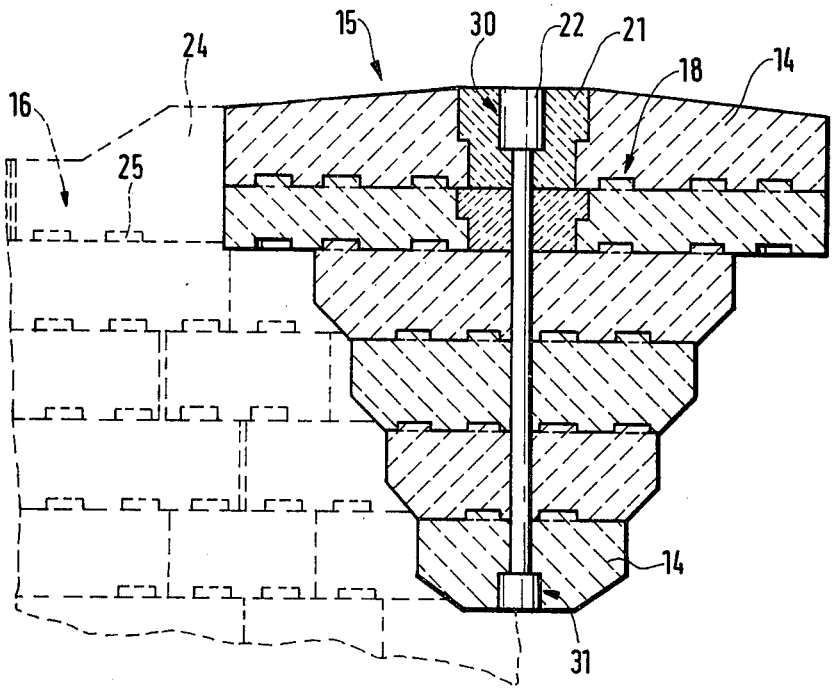

Additional features, advantages and possibilities of application of the present invention will result from the following description of embodiments given by way of example taken in conjunction with the accompanying drawings wherein:

FIG. 1 shows in longitudinal cut a ceramic burner equipped with a mixing body disposed in the foot of the burner shaft of an air heater according to the invention, FIG. 2 shows a molded brick of the topmost layer of the mixing body to be used according to the invention for the construction of the mixing body and viewed obliquely from below, FIG. 3 shows the manner of putting together the molded bricks according to FIG. 2 and their support with the aid of masonry brackets in top view of the mixing body, and FIG. 4 shows a vertical cut of the mixing body of the type according to the invention with the type of tie-in into a masonry bracket.

In FIG. 1, a burner shaft 1 of an air heater is shown which is formed by a fire-resistant masonry 2 and a sheet metal jacket 3 surrounding said masonry. In the base of the burner shaft 1, a burner made of fire-resistant material has been disposed with a fuel gas channel 4 central in relation to the axis A of the burner shaft and an annular air channel 6 separated by an annular wall 5 from the fuel gas channel 4, which air channel is limited on the outside by masonry 2 of the burner shaft 1. The channels 4 and 6 each have a supply channel 7 or 8 for the combustion media, gas or air, directed transversely to their longitudinal axis, whereby the supply channel 7 of the central fuel gas channel 4 has been laid on the bottom of the burner shaft 1, whereas the supply channel 8 belonging to the air channel 6 lies above this. Each of the channels 4 and 6 has a baffle diaphragm (constricting screen) 9 and 10 in the form of projections of the masonry. Of these, the baffle 9 of the central channel 4 for the combustion gas has been developed as a first areath of plurality of nozzles 11 which connects the air channel 6 with the central channel 4 for the combustion gas. Above the baffle screen 10 of the air channel 6, there is a second plurality of nozzles 12 which is followed by a burner port 13 widening up to the wall of the burner shaft 1. At the level of the upper wreath or plurality of nozzles 12, a mixing body 15 construction of molded bricks 14 in the axis A of the burner is carried tied into the masonry bracket 16 which start out from the annular wall 5 and which are directed toward the burner axis A. As shown in FIG. 3, the masonry brackets 16 subdivided the channel 4 for the combustion gas into similar longitudinal spaces.

According to FIG. 2, the molded bricks 14 from which the mixing body 15 is built up, have essentially a circular sector shape with a cut off point. On the underside 26 of the molded bricks 14, knobs 18 are provided which engage with corresponding recesses of the molded bricks of the adjoining layer of the mixing body 15. Mutually corresponding groove and rib elements 19, 20 are developed on the radial flanks 23 of the molded bricks 14, which in the example shown, are semicircular in their cross section, but may also be trapezoidal or triangular, for example. For the purpose of forming channels of the mixing body 15 for the passage of gas, the molded bricks 14 have apertures 17 for the passage of gas which are mutually aligned. The knobs 18 and the apertures 17 for the passage of gas may be distributed essentially arbitrarily. In FIG. 2, an eccentric arrangement of the aperture 17 for the passage of gas has been provided.

FIG. 3 illustrates the assembly together of sector-shaped, molded bricks of which six altogether form a circular layer of the mixing body. In the case of this embodiment, the apertures 17 for the passage of gas lie on the radial flanks 23 of the molded bricks 14 in order to avoid the formation of cracks as much as possible. Correspondingly, the knobs 18, as shown, may be disposed, for example, radially. The circular sector-shaped, molded bricks 14 abut with their vertical surfaces 27 pointing toward the burner axis A against corresponding surfaces 28 of a concentrically disposed polygonal sides of multi-edged molded brick 21 which in this case, is hexagonal. In the central bore 29 of molded brick 21, a vertical holding bar 22 also made of ceramic material, has been accommodated, which secures the layers of the mixing body 15 together vertically. As shown in FIG. 3, a masonry bracket 16 has advantageously been assigned to each sector-shaped, molded brick 14 of the layer, in which the mixing body 15 is tied in.

The manner of typing of the mixing body 15 into the masonry brackets 16 and the arrangement of the ceramic holding bar 22 is apparent from the cross sectional illustration of FIG. 4. The masonry brackets 16 are formed from molded bricks 24, which on their top and bottom sides have knobs 25 which engage with corresponding recesses of the counterpart molded brick in order to strengthen the tie. The ceramic holding bar 22 always has upper and lower widenings or enlargements 30 or 31 which are accommodated in corresponding recesses of the upper concentric molded brick 21 or the mold bricks 14 of the lowest layer, where such a concentric molded brick 21. Whereas in the case of the embodiment of FIG. 2, the knobs 18 are provided on the underside 26 of the molded bricks 14, in the case of the embodiment according to FIG. 4, the reverse case has been shown, in the case of which the knobs always lie on the upper side of the pertinent molded bricks 14 except for the topmost layer. The mixing body 15, according to the representation of FIG. 4, has been developed in the shape of a mushroom or a pear by a radius of the layers decreasing from top to bottom. The part of the mixing body 15 pointing downwards has been stepped off obliquely by corresponding molding of the molded bricks 14 and the upper side of the topmost layer because of irregular thickness of the bricks 14 used there, is approximately convex in order to create good flow conditions for the intermixing.

While there has been illustrated and described a preferred embodiment of the invention, it will be clear to those skilled in the art that modifications, adaptions and other embodiments of the invention can easily be carried out without departing from the spirit and scope of the invention as set out in the accompanying claims.

What is claimed is:

1. Ceramic burner for the combustion chamber of air heaters and the like having at least a pair of supply channels concentric to the burner axis for the combustion media, air and fuel gas, respectively, and with at least one connection provided at a level between the supply channels in their outlet area, whereby in the center of the burner, a mixing body, preferably having a plurality of apertures for the passage of gas, is provided in the direction of flow behind a connection of the supply channels, the improvement wherein said mixing body is comprised of layers of ceramic bricks, said bricks having essentially circular sector shape, said bricks adjoining each other with their radial flanks to form circular layers, said bricks having upper and lower sides, at least one knob on one of said sides and at least one recess on the other of said sides, said knobs provided on said sides being engaged with corresponding recesses of its counterpart sides, and said bricks interlocking with horizontal and/or vertical recess and rib elements provided in the said radial flanks, and wherein the layers of said mixing body are carried tied in by masonry brackets directed from the wall of the central supply channel to the central axis of the burner.

2. Ceramic burner as in claim 1, characterized in that the apertures for the passage of gas lie at the radial flanks of the shaped bricks, so that they are parted centrally by the radial flanks.

3. Ceramic burner as in claim 1, characterized in that the layers of the shaped bricks of the mixing body are held together vertically by means of a ceramic holding bar.

4. Ceramic burner as in claim 3, characterized in that the shaped bricks of one layer of the mixing body adjoin with a surface pointing toward the burner axis against corresponding surfaces of a many-sided, shaped brick surrounding the holding bar.

5. Ceramic burner as in claim 4, characterized in that the mixing body has a mushroom-shaped or pear-shaped cross section as shown in FIG. 4 such that the upper layers of the shaped bricks have a larger radius than the lower layers.

6. Ceramic burner as in claim 1, characterized in that the tying in of the mixing body into the masonry brackets reaches step wise up to the upper edge of the mixing body.

7. Ceramic burner as in claim 6, characterized in that said masonry brackets consist of shaped bricks which engage with knobs provided on their upper and/or under sides with corresponding recesses of the counterpart sides.

8. Ceramic burner as in claim 6, characterized in that a masonry bracket is assigned to each shaped brick of the topmost layer of the mixing body.

9. In a molded ceramic brick for use in constructing a mixing body for a ceramic burner in the combustion chamber of an air heater, the improvement comprising, a pair of generally planar converging sides, at least one rib in one of converging sides, at least one groove complementarily shaped with respect to said rib in the other of said converging sides, said at least one rib and said at least one groove being adapted to engage and receive, respectively, the rib and groove in the converging sides of an adjacent coplanar molded ceramic brick, top side and bottom side, respectively, said top and bottom sides being provided with knobs and recesses adapted to interfittingly lock with molded ceramic bricks engaging on said top and bottom sides of said brick, and a first end surface extending between the converging ends of said converging sides, a second end surface between the diverging ends of said converging sides, and means forming at least a portion of an aperture extending between said top and bottom sides of said brick and adapted to align with apertures in the molded ceramic bricks in said mixing body and form a passage for gas flow.

10. The molded ceramic brick as defined in claim 9 wherein said means forming at least a portion of an aperture is in one of said converging sides for co-acting with a like portion of an aperture portion in one of said converging sides of an adjacent molded ceramic brick to form a passage for gas to flow.

* * * * *